United States Patent [19]

Eckart et al.

[11] 4,302,225

[45] Nov. 24, 1981

[54] HAND VACUUM CLEANER

[75] Inventors: Manfred Eckart, Wuppertal; Peter Wulf, Ennepetal, both of Fed. Rep. of Germany

[73] Assignee: Vorwerk & Co. Interholding GmbH, Wuppertal, Fed. Rep. of Germany

[21] Appl. No.: 157,639

[22] Filed: Jun. 6, 1980

Related U.S. Application Data

[63] Continuation of Ser. No. 7,410, Jan. 29, 1979, abandoned.

[30] Foreign Application Priority Data

Feb. 2, 1978 [DE] Fed. Rep. of Germany ..... 2805393

[51] Int. Cl.[3] ..... B01D 47/02; A47L 5/24

[52] U.S. Cl. ..... 55/234; 55/276; 55/279; 55/357; 55/472; 55/473; 55/482; 55/DIG. 3; 15/326; 15/327 E; 15/344; 181/231; 181/257

[58] Field of Search ..... 55/234, 276, 279, 316, 55/318, 356, 357, 469, 472, 473, 482, DIG. 3; 181/231, 257; 422/122, 124; 15/326, 327 E, 344, 350, 351, 353

[56] References Cited

U.S. PATENT DOCUMENTS

| | | | |
|---|---|---|---|
| 1,064,412 | 6/1913 | White | 55/472 |
| 1,121,542 | 12/1914 | Wegner | 55/234 |
| 1,336,994 | 4/1920 | Barnes | 15/344 |
| 2,018,207 | 10/1935 | Giambertoni | 55/276 |
| 2,631,688 | 3/1953 | Osborne et al. | 55/279 |
| 3,344,588 | 10/1967 | Szabo | 55/276 |
| 3,496,703 | 2/1970 | MacLeod et al. | 55/356 |
| 3,588,944 | 6/1971 | Fromknecht et al. | 55/473 |
| 4,052,765 | 10/1977 | Gühne et al. | 55/344 |
| 4,171,553 | 10/1979 | Stein | 15/350 |

FOREIGN PATENT DOCUMENTS

| | | | |
|---|---|---|---|
| 1292820 | 4/1969 | Fed. Rep. of Germany | 15/344 |

*Primary Examiner*—David L. Lacey
*Attorney, Agent, or Firm*—Michael J. Striker

[57] ABSTRACT

A hand vacuum cleaner includes a housing having an inlet and an outlet, and a front and a rear part connectable with each other so as to constitute the housing. The housing has a front face and a rear face spaced from the inlet in the flow direction of incoming contaminated air entering the housing. A dust filter is located in the housing at the rear face thereof. A blower is located in the housing for aspirating the contaminated air into the housing through the inlet and into the dust filter and for urging the filtered air therefrom in a second direction towards the outlet. An intermediate plate is provided in the interior of the housing, which has a first formation constituting a first passage for the incoming contaminated air, a second formation constituting a second passage for guiding the filtered air from the dust filter towards the outlet and a third formation for fixing thereon the blower.

13 Claims, 12 Drawing Figures

FIG. 6
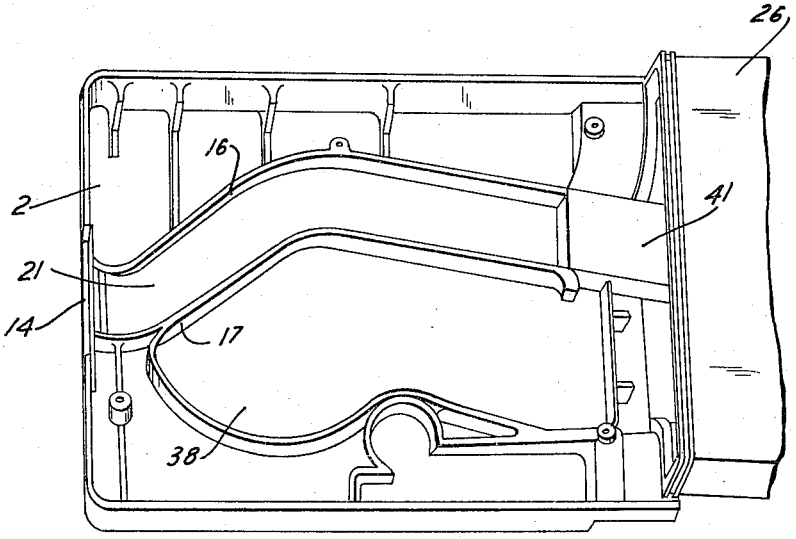
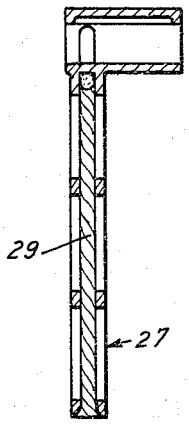
FIG. 11
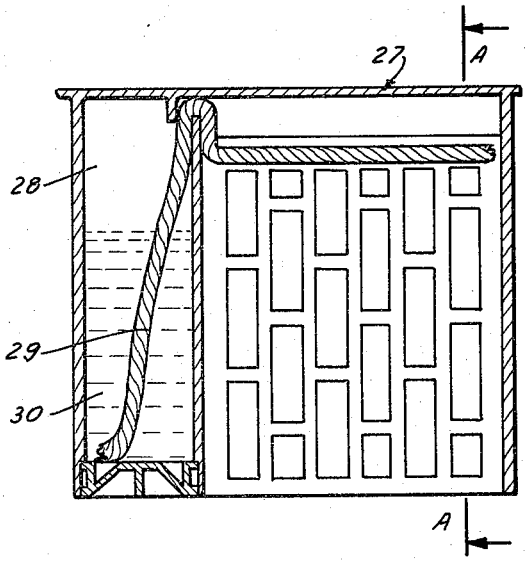
FIG. 10

HAND VACUUM CLEANER

CROSS-REFERENCE TO RELATED APPLICATION

This application is a continuation of parent application Ser. No.: 7,410 filed Jan. 29, 1979 now abandoned.

BACKGROUND OF THE INVENTION

The present invention relates to vacuum cleaners.

More particularly, the present invention concerns hand vacuum cleaners.

It is known in the prior art of vacuum cleaners to provide a hand vacuum cleaner with a dust filter which is located above a blower and is aero-dynamically connected thereto (see German Pat. No. 632 189). Such a hand vacuum cleaner includes a blower housing and a dust filter housing superimposed on the blower housing and an intake tube which extends along the blower housing into the dust filter housing. The intake tube extends outside the blower housing. One end portion of the intake tube is connected to a closure of the blower housing at the upper surface thereof on which there is also located the dust filter. The intake tube has a bent portion immediately before the end portion of the tube which end portion is inserted into the closure of the housing. The bent portion serves as a handle for carrying the hand vacuum cleaner. The advantage of such an arrangement of the blower and the dust filter relative to each other, namely a convenient overall weight distribution of the hand vacuum cleaner and a reliable cleaning effectiveness thereof, are stipulated to the great extent by location of the intake tube. In other words, it is very important during assembling a hand vacuum cleaner to choose a blower and a dust filter of a certain predetermined weight, and then so to arrange the intake tube on the blower and dust filter that the joint unit of the inlet portion of the tube into the dust filter housing and the other joints would not become deteriorated (i.e., broken, wrecked, disassembled, etc.) during operation of the hand vacuum cleaner.

Moreover, due to the requirements as to the weight relationship between the parts of the hand vacuum cleaner and due to rather severe working conditions of the hand vacuum cleaner the intake tube can not be of synthetic plastic material. Obviously, use of any other more rigid material for the intake tube correspondingly increases the cost of the tube in particular and the overall cost of the hand vacuum cleaner in general.

SUMMARY OF THE INVENTION

It is a general object of the present invention to avoid the disadvantages of the prior art hand vacuum cleaners.

More particularly, it is an object of the present invention to provide such a hand vacuum cleaner which has two parts, that is a dust filter and a hollow housing encompassing in the interior thereof all other elements of the hand vacuum filter, i.e. an intake tube, a blower, an additional filter, etc.

In pursuance of these objects and others which will become apparent hereafter, one feature of the present invention resides in providing a housing which has an inlet and an outlet and includes a front part and a rear part connectable with said front part constituting together therewith said housing. The housing has a front face which is provided with said inlet and a rear face which is spaced from said inlet in the flow direction of incoming contaminated air entering said housing. A dust filter is located in said housing at the rear face thereof. The dust filter is operative for filtering the contaminated air which is received in the housing through the inlet thereof. There is mounted in the housing a blower for aspirating the contaminated air into the housing in a first direction through said inlet and into said dust filter and for urging the filtered air therefrom in a second direction towards said outlet of the housing. One of the main advantageous features of the present invention resides in providing an intermediate plate in the interior of said housing, which plate has a first formation which constitutes with said front part first passage means for receiving the contaminated air from said inlet for movement in said first direction towards said rear face of the housing. The plate is provided with a second formation which constitutes with said rear part second passage means for guiding the filtered air from said dust filter in said second direction towards said outlet of the housing. The plate is provided with a third formation which constitutes a recess for so receiving said blower that the latter blows the filtered air from said dust filter through said second passage means in said second direction towards said outlet.

Another advantageous feature of the present invention resides in a fourth and fifth formation on said intermediate plate. These formations are operative for supporting in the interior of the housing a sound-damping (i.e. absorbing) arrangement and an additional filter, respectively. The additional filter is operative to filter the air before the latter leaves the housing through the outlet thereof.

In order to eliminate any additional fixing elements on the intake stack of the housing the intermediate plate is provided at the front end portion thereof with a circumferential groove which engages with the corresponding so-called "spring" projection on the front or rear part of the housing. Thus, this projection snaps around the circumferential groove of the intermediate plate so as to arrest the latter in a rigid position on and relative to the corresponding part of the housing. The intake stack may be integrally connected with said intermediate plate.

In accordance with another advantageous feature of the present invention the intermediate plate sealingly separates the first passage means (i.e. intake passage) from the second passage means (i.e. leading to the outlet of the housing).

The recess for the blower has a circular cross-section of a predetermined diameter so that the blower is tightly received in said recess to thereby constitute a sealing against the second passage means. In order to insure that the blower is fixedly connected to the intermediate plate, the latter is provided with an elastic holding ring which is connected with the wall of the circular recess. The sound damper is located in the housing on the intermediate plate between the blower and the dust filter. The second passage means may be provided with an additional filter which is located along the second passage means after the sound damper. The additional filter comprising a bacteria filter for absorbing the bacteria from the filtered air before the latter leaves the housing through the outlet thereof. The bacteria filter is provided with a liquid tank and a weak disinfection means so as to absorb the bacteria from the filtered air.

The rear part of the housing abuts the elastic holding ring so as to constitute together therewith a spiral channel.

Thus, the hand vacumm cleaner in accordance with the present invention constitutes a compact and reliable vacuum cleaner which can be assembled in a simple and reliable manner. It is to be noted that the hand vacuum cleaner in accordance with the present invention has the overall dimensions similar to those of the conventional hand vacuum cleaners. Similar to the conventional vacuum cleaners the one described in the present application has the intake stack on one side of the housing for aspirating the contaminated air.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 6-is still another top view of the interior of the hand vacuum cleaner shown in FIGS. 4 and 5 with a removed intermediate plate;

FIG. 10-is a longitudinal sectional view of a bacteria filter in accordance with the present invention;

FIG. 11-is a sectional view taken along the line A—A in FIG. 10; and

DESCRIPTION OF THE PREFERRED EMBODIMENTS

Figure 1:
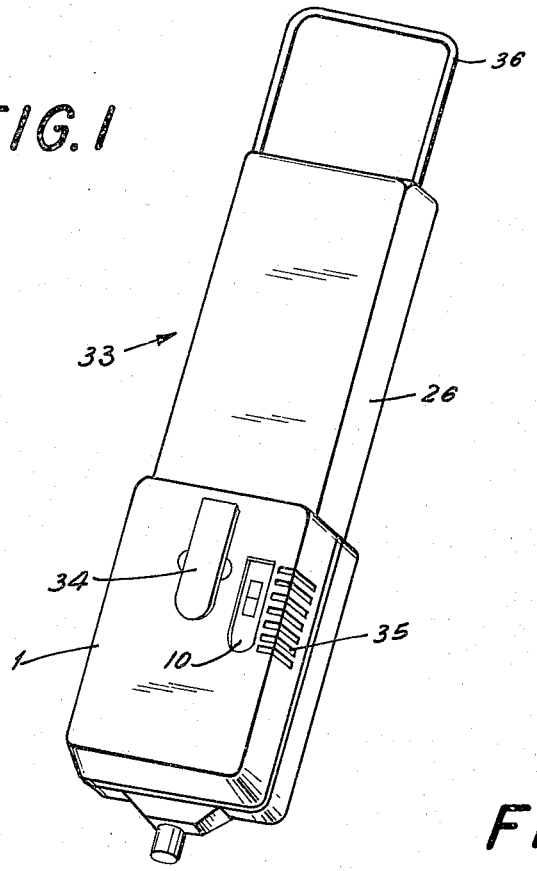
FIG. 1-a perspective view of a hand vacuum cleaner in accordance with the present invention.
Figure 2:
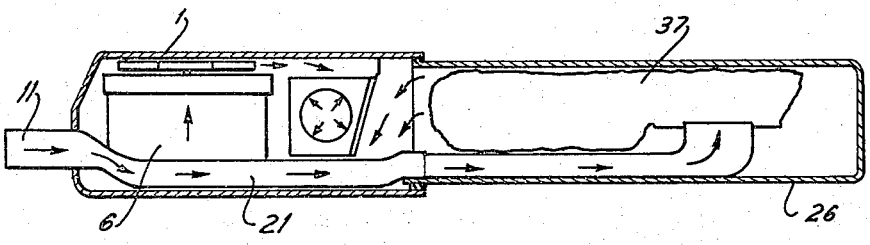
FIG. 2-a side view of a principle scheme of the vacuum cleaner.
Figure 3:
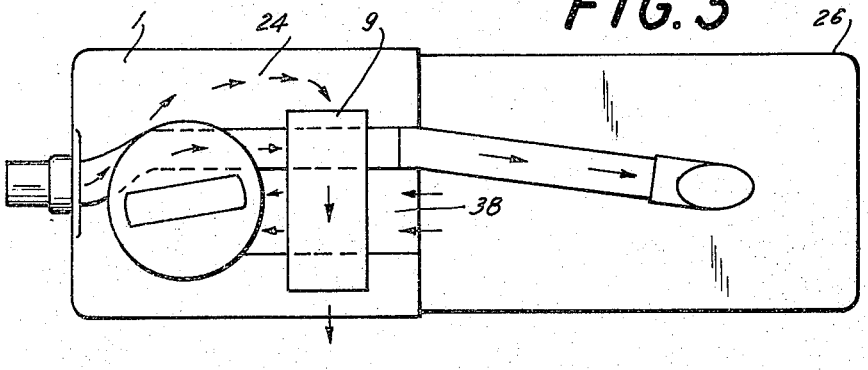
FIG. 3-a top view of a principle scheme of the hand vacuum cleaner shown in FIG. 2.

Referring now to the drawings and first to the FIG. 1 thereof, it may be seen that the reference numeral 33 designates a hand vacuum cleaner in toto. The hand vacuum cleaner includes a main housing 1 and a dust filter housing 26. The main housing 1 is provided with a carrying handle 34, an additional filter 10 which may be formed as a bacteria filter, and an outlet slotted hole 35. The additional filter 10, which is accessible from outside, will be described in detail later on. The dust filter housing 26 is provided with another carrying handle 36. The function of the hand vacuum cleaner 33 is shown in principle in FIGS. 2 and 3. A contaminated air is aspirated into the main housing 1 through an inlet stack 11 and passes through an intake passage 21 into a dust filter 37. From the dust filter 37 (i.e. the dust filter housing 26) a filtered air enters a channel 38 and from that into a motor-blower unit 6 (i.e. blower). From the blower 6 the filtered air enters a channel 24 and then a sound-absorber 9. From the sound-absorber 9 the filtered air may go directly or through an additional filter 10 (see FIG. 1) into the outlet slotted hole 35.

Figure 9:
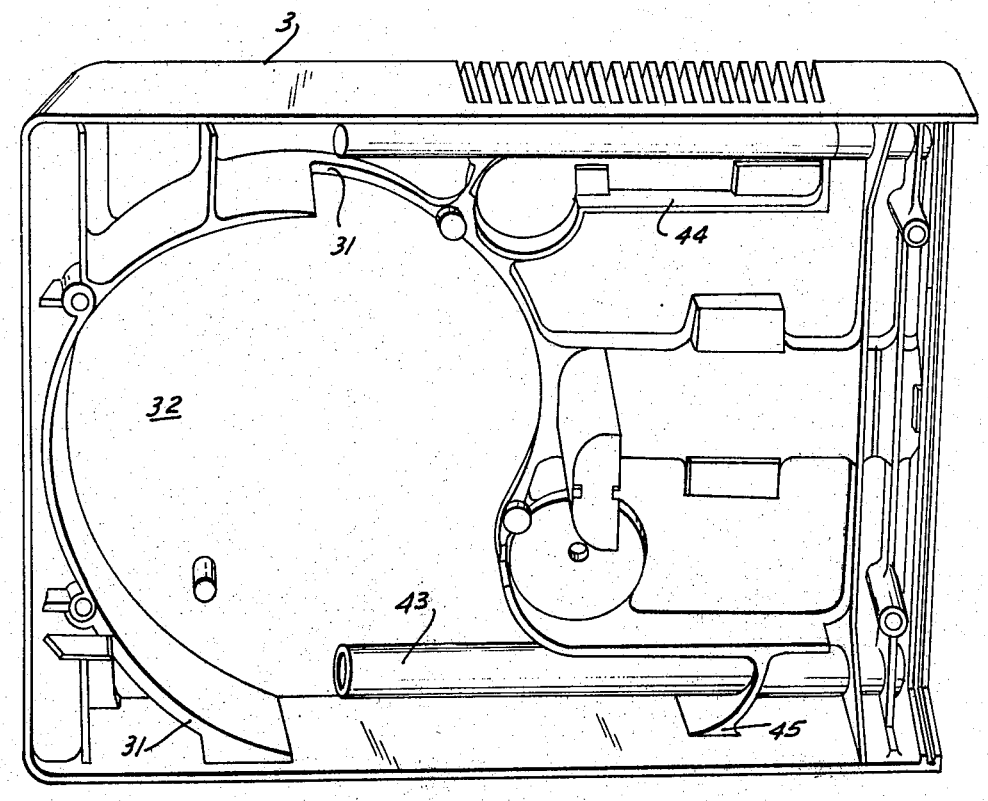
FIG. 9-is a front view of the rear part.

The housing 1 includes two parts, i.e. a front part 2 (see FIG. 4) and a rear part 3 (see FIG. 9).

Figure 4:
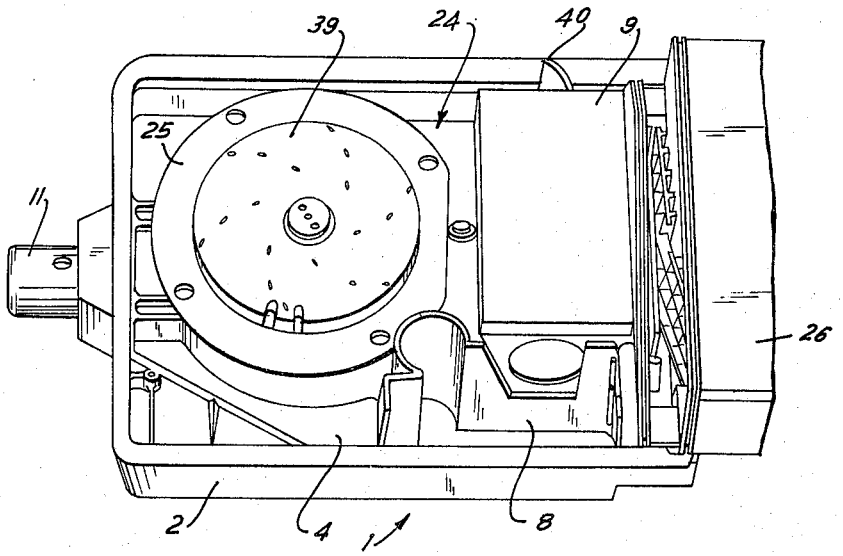
FIG. 4-is a top view of the interior of the hand vacuum cleaner with a removed rear part.

FIG. 4 shows the interior of the housing 1 with the rear part 3 removed from the front part 2. The filter dust housing 26 is shown only partially, since the inside of the dust filter has very little importance for the present invention.

The front part 2 is provided with an intermediate plate 4 which has the intake stack 11. The intake stack 11 is integrally connected to the intermediate plate 4. A blower 39 of the motor-blower unit 6 is shown in the center of the intermediate plate 4 (see FIG. 4). The blower 39 is located above an elastic holding ring 25. The reference numeral 9 is used to designate a sound absorber which is located in the channel 24 (see also FIG. 5). A partition 40 guides the air flow into the sound absorber 9. The partition 40 is located immediately before the sound absorber 9. The channel 24 is completed only when the rear part 3 engages the front part 2. The plate 4 is further provided with another recess 8 just behind the sound absorber 9. The recess 8 is used for receiving an additional filter 10 (see FIG. 1).

Figure 5:
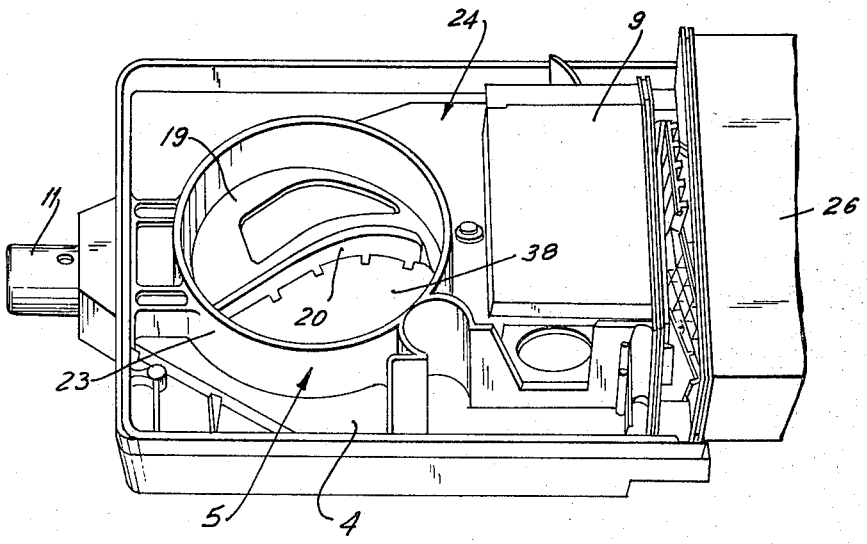
FIG. 5-is another top view of the interior of the hand vacuum cleaner shown in FIG. 4 with a removed blower.

FIG. 5 shows the interior of the housing 1 as shown in FIG. 4 only without the motor blower unit 6 which is withdrawn from a recess 5 provided on the intermediate plate 4 for this unit. A circular wall 23 on the plate 4 sealingly separates the channel 24 from the channel 38. The intermediate plate 4 is further provided with a surface 19 and a shoulder 20, which constitute together the intake passage 21 (see also FIG. 6). The passage 21 is more clearly shown in FIG. 6 as constituted by side walls 16 and 17 extending on the plate 4 parallel to each other. The intake passage 21 is separated by the surface 19 and the shoulder 20 from the channel 38. The contaminated air passes through the passage 21 and a connected passage 41 into the dust filter 37 (see FIGS. 2 and 3). The filtered air exits the dust filter housing 26 back into the housing 1 through the channel 38 and into the motor blower unit 6 (see FIGS. 2, 3 and 4). The front part 2 is provided with a recess 14 which receives the intake stack 11 of the plate 4 when the latter is in assembly with the front part 2.

Figure 7:
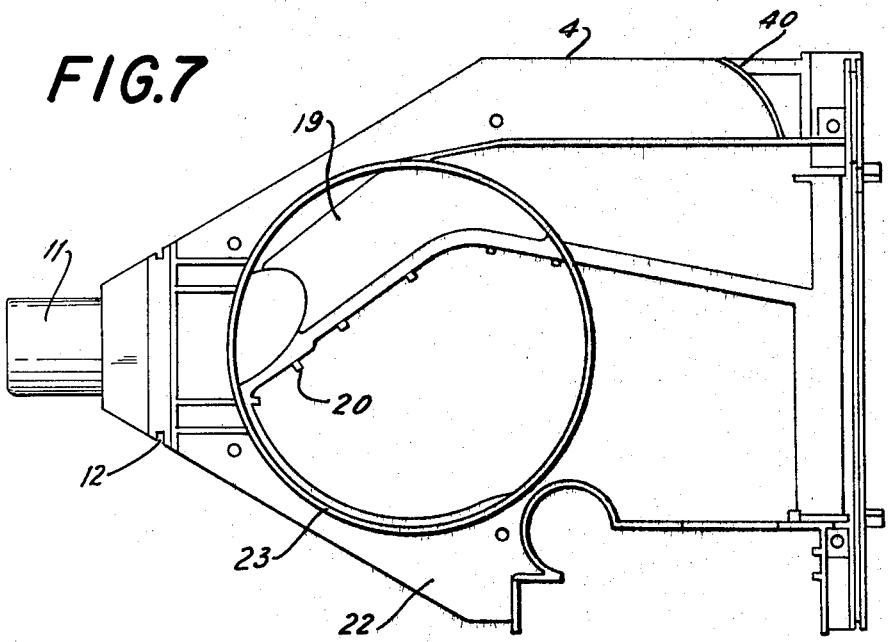
FIG. 7-is a top view of the intermediate plate.

FIG. 7 shows the intermediate plate 4 viewed from above, that is from a side 22, which after the plate 4 is assembled on the front part 2 will face the rear part 3. The intake stack 11 is integrally connected to the plate 4. The plate 4 is provided with a groove 12 which is received in the recess 14 of the front part 2 (see FIG. 6). The circular wall 23 receives the motor blower unit 6. The surface 19 and the shoulder 20 separate the intake passage 21 (see FIG. 6). The upper surface of the plate 4 is provided with a partition 40.

Figure 8:
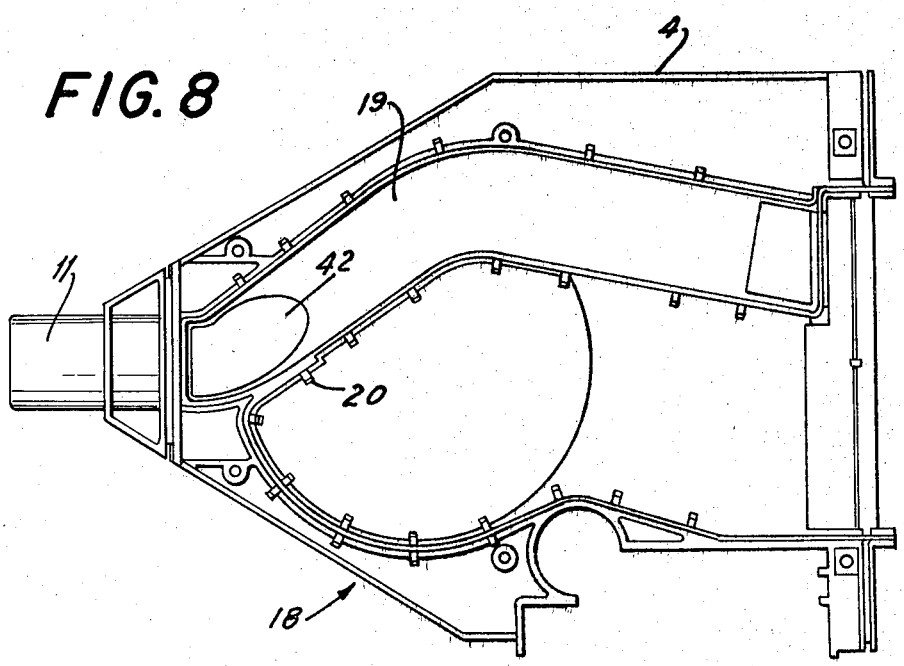
FIG. 8-is a bottom view of the intermediate plate.

FIG. 8 shows the intermediate plate 4 viewed from below, that is from a side 18 which after the plate 4 is assembled on the front part 2 will face the same. The plate 4 (see FIGS. 8 and 7) is provided with an opening 42 which connects the intake passage 21 (see FIG. 6), which is separated by the surface 19 and the shoulder 20, with the intake stack 11.

FIG. 9 shows the rear part 3 which is to be installed on the front part 2 so as to constitute together the housing 1 (see FIG. 1). The rear part 3 is provided with a wall 31 which engages the elastic holding ring 25 (see FIG. 4) when the part 2 is in assembly with the part 3, so that the wall 31 and the ring 25 together constitute a spiral channel 32. A tubular portion 43 constitutes a portion of the carrying handle 36 (see FIG. 1). A wall 44 is located in the recess 8 (see FIG. 4) and a wall 45 engages the wall 40 (see FIG. 4) when the front and rear parts are in assembly with each other. Thus all additional passages are sealed from each other, since both walls 40 and 45 engage the plate 4 when the parts 2 and 3 are in assembly.

FIGS. 10 and 11 show so-called bacteria filter 27, which is located between the sound absorber 9 and the outlet hole 35 and includes a liquid tank 28 having a wick 29 with disinfection liquid 30.

Figure 12:
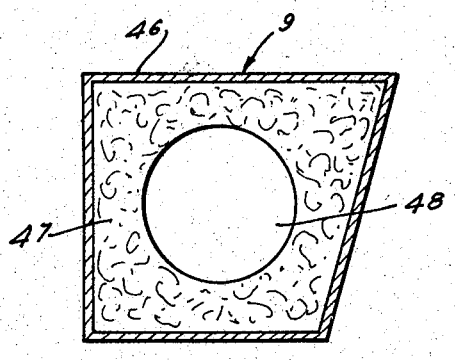
FIG. 12-is a sectional view of a sound absorber.

FIG. 12 shows a section taken along the sound damper 9, which includes a rigid casing 46 filled with a sound-absorbing material 47. The sound-absorbing material forms a round channel 48 for allowing the air flow therethrough.

It will be understood that each of the elements described above, or two or more together, may also find a useful application in other types of a hand vacuum cleaner differing from the types described above.

While the invention has been illustrated and described as embodied in a hand vacuum cleaner it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A vacuum cleaner, comprising an elongated housing including a first housing portion and a second housing portion connected thereto; said first housing portion defining a first chamber having an inlet to admit contaminated air thereto, and an outlet to discharge cleaned air therefrom, and an intermediate plate positioned within said first housing portion and extending from one end of said first chamber to another end thereof, said second housing portion defining a second chamber; a dust filter located in said second chamber and operative for filtering the contaminated air admitted into said housing, said intermediate plate being formed with a first recess; a motor-blower unit located in said first recess and having a blower and motor operative for aspirating the contaminated air received through said inlet and directing the same toward said dust filter; a first passage means formed on said intermediate plate and forming therewith a first passage being connected to said inlet and constructed and arranged for guiding the contaminated air in a first direction from said inlet toward said dust filter; and a second passage means formed on said intermediate plate and forming therewith a second passage arranged in communication with said dust filter and constructed and arranged for guiding the filtered air in a second direction opposite to the first direction, from said dust filter toward said motor-blower unit which urges the filtered air from said dust filter toward said outlet and said first and second passage means are constructed and arranged such that said first and second passages are formed as separate air aspirating and air discharging passages.

2. A vacuum cleaner as defined in claim 1, wherein said intermediate plate is further provided with a circumferential groove, at least one of said housing portions being provided with a projection operative to engage said groove on said intermediate plate to thereby arrest said plate when said first and said second housing portions are in assembly with each other.

3. A vacuum cleaner as defined in claim 1, wherein said inlet is integrally connected with said intermediate plate.

4. A vacuum cleaner as defined in claim 1, wherein said intermediate plate has an upper surface, said first recess being located on said upper surface of said plate.

5. A vacuum cleaner as defined in claim 4, wherein said first recess has a circular cross-section and includes a circular projection extending away from said upper surface of said first plate, said recess having a predetermined inner diameter for tightly receiving therein said motor-blower unit.

6. A vacuum cleaner as defined in claim 5, wherein said circular projection is provided with an elastic ring connecting said motor-blower unit to said circular projection.

7. A vacuum cleaner as defined in claim 1, further comprising an additional filter, and wherein said intermediate plate is formed with a second recess, said additional filter being located in said second recess and positioned and arranged for filtering the air before the same leaves said housing through said outlet.

8. A vacuum cleaner as defined in claim 7, wherein said additional filter includes a bacteria filter.

9. A vacuum cleaner as defined in claim 8, wherein said bacteria filter includes a liquid tank provided with means for drawing liquid from said tank into flow contact with the flow of air.

10. A vacuum cleaner as defined in claim 1, wherein said first passage means include two vertical walls extended outwardly from said intermediate plate and spaced from each other so as to define the width of said first passage.

11. A vacuum cleaner as defined in claim 10, where said said walls are located on said upper surface of said plate.

12. A vacuum cleaner as defined in claim 11, further comprising sound damping means including a sound absorber.

13. A vacuum cleaner as defined in claim 12, wherein said sound absorber is located between said motor-blower unit and said outlet.

* * * * *